United States Patent [19]

Hashish et al.

[11] Patent Number: 4,934,111

[45] Date of Patent: Jun. 19, 1990

[54] APPARATUS FOR PIERCING BRITTLE MATERIALS WITH HIGH VELOCITY ABRASIVE-LADEN WATERJETS

[75] Inventors: Mohamed A. Hashish, Kent; Steven J. Craigen, Auburn; Paul Tacheron, Renton, all of Wash.

[73] Assignee: Flow Research, Inc., Kent, Wash.

[21] Appl. No.: 308,730

[22] Filed: Feb. 9, 1989

[51] Int. Cl.[5] ..... B24C 5/04

[52] U.S. Cl. ..... 51/410; 51/439; 83/53

[58] Field of Search ..... 51/410, 436, 438, 439; 83/53, 177

[56] References Cited

U.S. PATENT DOCUMENTS

| | | | |
|---|---|---|---|
| 2,985,050 | 5/1961 | Schwacha | 83/53 |
| 4,313,570 | 2/1982 | Olsen | 175/424 |
| 4,532,949 | 8/1985 | Frank | 83/177 X R |
| 4,563,840 | 1/1986 | Urakami | 51/410 |
| 4,583,329 | 4/1986 | Lang | 51/410 |
| 4,594,924 | 6/1986 | Windisch | 83/177 |
| 4,648,215 | 5/1987 | Hashish et al. | 51/439 |
| 4,656,791 | 5/1987 | Herrington et al. | 51/410 |
| 4,666,083 | 5/1987 | Yie | 51/439 |
| 4,693,153 | 9/1987 | Wainright et al. | 83/53 |
| 4,698,939 | 10/1987 | Hashish | 51/410 |
| 4,702,042 | 10/1987 | Herrington et al. | 51/321 |
| 4,703,591 | 10/1987 | Herrington et al. | 51/321 |
| 4,707,952 | 11/1987 | Krasnoff | 51/410 |
| 4,817,874 | 4/1989 | Jarzebowicz | 239/434 |

FOREIGN PATENT DOCUMENTS

| | | | |
|---|---|---|---|
| 0119338 | 9/1984 | Fed. Rep. of Germany | 83/177 |

*Primary Examiner*—Frederick R. Schmidt
*Assistant Examiner*—Maurina Rachuba
*Attorney, Agent, or Firm*—Ashen Golant Martin & Seldon

[57] ABSTRACT

An abrasivejet system for cutting brittle materials is disclosed. One feature of the disclosed system is a jet-producing nozzle assembly which includes means for inducing turbulence in the jet-forming liquid during the period in which the jet initially impacts on the brittle material so that impact stress on the material is reduced. A second disclosed feature is a supplementary suction device, preferable in the form of a second nozzle dimensioned for maximum suction, which maintains a generally constant feed rate of abrasive into the cutting nozzle assembly during the turbulence-inducing phase of operation.

24 Claims, 3 Drawing Sheets

APPARATUS FOR PIERCING BRITTLE MATERIALS WITH HIGH VELOCITY ABRASIVE-LADEN WATERJETS

BACKGROUND OF THE INVENTION

The use of high velocity, abrasive-laden liquid jets to precisely cut a variety of materials is well known. Briefly, a high velocity waterjet is first formed by compressing the liquid to an operating pressure of 35,000 to 70,000 psi, and forcing the compressed liquid through an orifice having a diameter approximating that of a human hair; namely, 0.001–0.015 inches. The resulting highly coherent jet is discharged from the orifice at a velocity which approaches or exceeds the speed of sound.

The liquid most frequently used to form the jet is water, and the high velocity jet described hereinafter may accordingly be identified as a waterjet. Those skilled in the art will recognize, however, that numerous other liquids can be used without departing from the scope of the invention, and the recitation of the jet as comprising water should not be interpreted as a limitation.

To produce the abrasive-laden waterjet, the high velocity jet thus formed is passed through a mixing region, which is typically within the same housing as the aforedescribed components. A quantity of abrasive is entrained into the jet in the mixing region by the low pressure region which surrounds the flowing liquid in accordance with the Bernoulli Principle. The abrasive is typically (but not limited to) a fine silica or garnet, and is coupled into the mixing region from a hopper which is external to the nozzle housing.

The abrasive-laden waterjet is discharged against a workpiece which is supported closely adjacent to the discharge information and details end of the nozzle housing. Additional concerning abrasivejet technology may be found in my U.S. Pat. No. 4,648,215, the contents of which are hereby incorporated by reference. The term "abrasivejet" is used herein as a shorthand expression for "abrasive-laden waterjet" in accordance with standard terminology in the art.

Although abrasivejets have been used to cut a wide variety of materials, no commercially satisfactory apparatus has been available for drilling brittle, composite, or laminated materials. These materials tend to chip, crack, fracture, or delaminate when impinged upon by the jet. One presently known technique for cutting glass is disclosed in U.S. Pat. No. 4,072,042, wherein a starting hole is first drilled through the workpiece by a relatively low-pressure abrasivejet, and the pressure of the jet-forming fluid is then increased to the high pressure required for cutting.

The Bernoulli effect at such low pressure operations appears to be insufficient to properly entrain abrasives from the external hopper, and cutting systems utilizing low-pressure drilling accordingly provide inconsistent results. It has been found, for example, that the drilling rates are sometimes lower than expected and, in many cases, only limited drilling depths are possible. These drawbacks are aggravated when the starting hole is drilled at a point relatively remote from the workpiece edge and the portion of the workpiece containing the drilled starting hole must usually be scrapped because of damage to the area adjacent the hole.

SUMMARY OF THE INVENTION

An abrasivejet cutting system is disclosed herein which drills and cuts brittle material, without destruction of the workpiece. The system includes a cutting nozzle housing having a fluid-conducting, generally axially-extending passage extending from an upstream end region to a downstream end region. The housing has an inlet port communicating with the upstream end region for permitting the ingress of high pressure liquid into the passage.

Orifice-defining means positioned in the downstream end region of the passageway produces a highly coherent, high velocity cutting jet from the high pressure fluid passing through the orifice. Means are included in the assembly for conducting abrasive particles from an external abrasive source to a mixing region within the housing which is adjacent to the high velocity jet so that the abrasive becomes entrained with the jet by the low pressure region which surrounds the moving liquid. In addition, means are included for discharging the abrasive-laden jet from the downstream end of the housing.

The system includes means for reducing the impact stress of the abrasivejet on the workpiece until at least the top surface of the workpiece has been pierced. In accordance with one embodiment, the impact stress is reduced by a reduction in the pressure of the jet-forming liquid prior to formation of the jet. A pressure-reducing orifice is placed in the supply line to the cutting jet, together with a bypass valve that selectively decouples the pressure-reducing orifice from the supply line. The high pressure, jet-forming liquid is forced through the pressure-reducing orifice during the workpiece-piercing (i.e., drilling) phase of operation, and bypasses the orifice during the normal cutting phase.

In accordance with another embodiment of the invention, the impact stress is reduced by means which degrade the coherency of the jet during the workpiece-piercing phase. The coherency of the jet is degraded by means which creates turbulence in the jet-forming liquid upstream or downstream of the jet-forming orifice. The coherency of the waterjet is restored after the workpiece has been pierced by the abrasivejet.

It has been discovered that inconsistent results obtained during the workpiece-piercing phase of the cutting operation can result from irregular feed rates associated with the abrasive. The irregular feed rates appear to be caused by the reduction in pressure and/or jet velocity (when turbulence is created) during the drilling phase. At these lower pressures and/or lower velocities, the low-pressure region surrounding the jet in accordance with the Bernoulli effect is apparently insufficient to entrain abrasive at the sufficiently consistent feed rate required for consistent results.

Accordingly, the system disclosed herein includes auxiliary means for compelling abrasive through the mixing region in the nozzle housing during the drilling phase so that a generally consistent feed rate is maintained independent of the cutting jet's characteristics. The cutting nozzle assembly includes an auxiliary conduit which communicates with the mixing region. A source of partial vacuum is operatively coupled to the auxiliary conduit during the drilling phase, and draws abrasive from the external abrasive source through the mixing region and out the auxiliary conduit.

In the preferred embodiment, the partial vacuum source is an auxiliary waterjet nozzle assembly coupled to the cutting nozzle assembly in a manner which enables the auxiliary jet to pull abrasive through the mixing region of the cutting nozzle assembly. Since the auxiliary jet is not discharged against a workpiece, and performs no cutting or drilling, the components and dimensions of the auxiliary assembly may be sized for optimum siphoning characteristics.

Additional information and details concerning the invention will be apparent from the following description of the preferred embodiment, of which the drawing is a part.

DESCRIPTION OF THE PREFERRED EMBODIMENT

Figure 1:
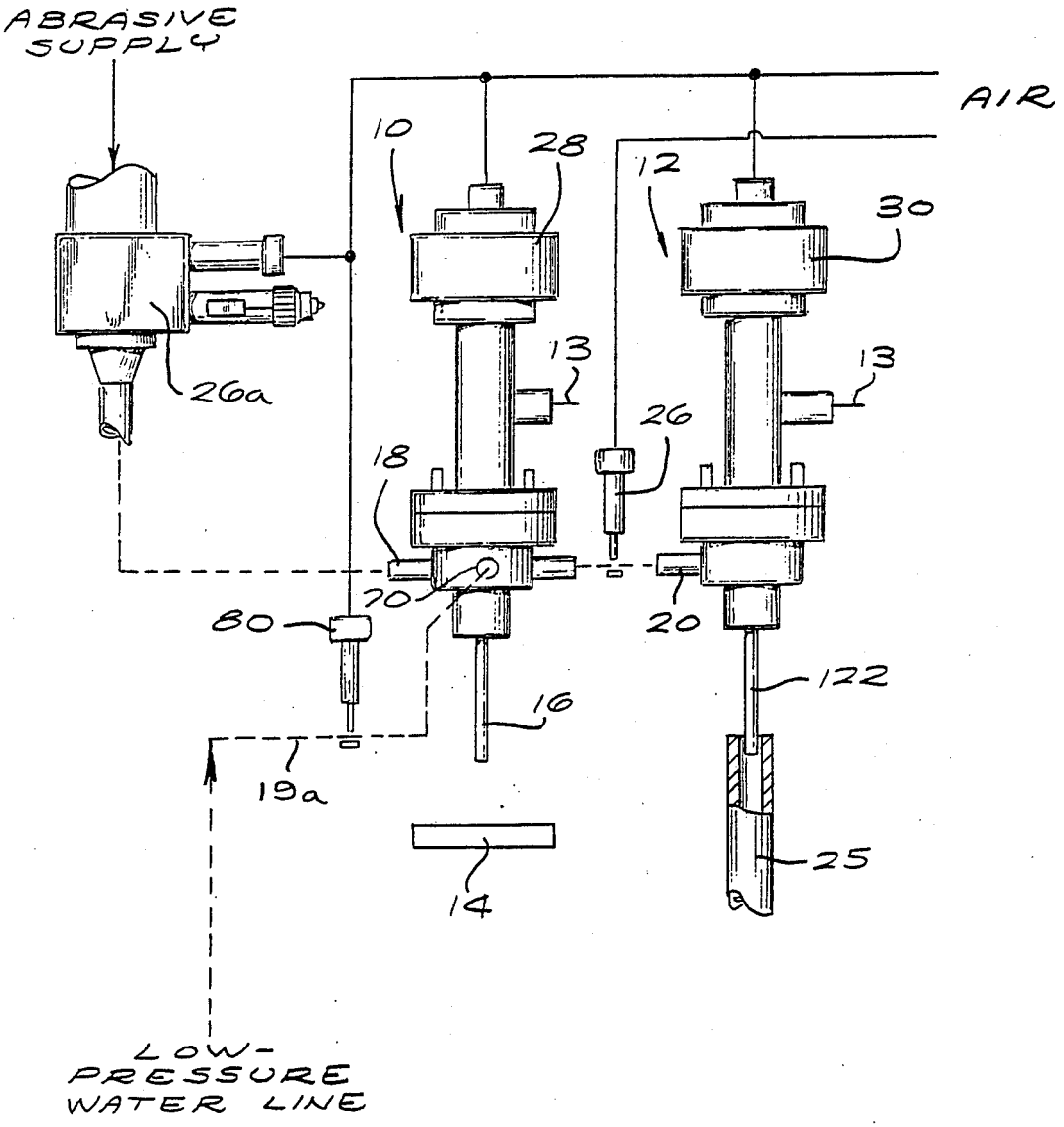
FIG. 1 is a schematic illustration of an abrasivejet nozzle arrangement constructed in accordance with the invention.

FIG. 1 is a schematic illustration of an abrasivejet nozzle arrangement constructed in accordance with the invention. A pair of abrasivejet nozzle assemblies 10, 12 are depicted, each of which is coupled to a source of high pressure water via a respective inlet port 13. The term "high pressure" is used to denote pressures in the range of 35,000 to 55,000 psi. Those skilled in the art will recognize that the sources of such highly pressurized water are typically intensifier pumps which form part of an abrasivejet cutting system. A description of these pumps is beyond the scope of this specification, and is accordingly omitted for the sake of brevity.

The nozzle assembly 10 is mounted for movement with respect to a workpiece 14 in any manner known in the art. Typically, an X-Y carriage is employed for such purposes, and the movement is controlled by a microprocessor. The nozzle assembly 10 includes a discharge tube 16 from which an abrasive-laden, highly coherent, high velocity jet of liquid exits the assembly. The downstream end of the tube 16 is positioned closely adjacent the workpiece during the cutting operation. In practice a set-off distance of 0.10 inches is satisfactory.

Abrasive particles are conducted into the cutting nozzle assembly 10 from an external hopper, or other source, through an abrasive-conducting inlet 18. As is known in the art, the abrasive typically comprises (but is not limited to) a fine garnet or silica powder, and is drawn into the assembly by the low pressure surrounding the moving jet in accordance with the Bernoulli Principle. Additional details concerning the formation of abrasive jets are set forth in U.S. Pat. No. 4,648,215 which issued on Mar. 10, 1987 to Hashish, et. al. The contents of that patent are incorporated by reference. Additional details concerning the preferred components of the cutting nozzle assembly 10 are discussed below with respect to FIG. 2A.

The cutting nozzle assembly 10 further includes a fluid inlet 70 which, as also described in greater detail below, permits the ingress of a jet-degrading fluid into an internal mixing region 58 (FIG. 2A) where the abrasive is introduced into the cutting jet. The fluid inlet 70 communicates with a source of liquid via a conduit **19*a*** such that a flow of water up to 10 gpm and pressure up to 100 psi can be introduced into the chamber which contains the mixing region. In practice, a length of Tygon tubing having a 0.15-inch I.D. and a 3 ft. length coupled to an ordinary 60 $lb/in^2$ water line of the type supplying normal drinking water has been found satisfactory.

As discussed in more detail below, the second nozzle assembly 12 is utilized as a partial vacuum source to maintain a substantially constant flow rate of jet-degrading fluid and abrasive through the cutting nozzle assembly 10. The vacuum nozzle assembly 12, which may conveniently be mounted for ganged movement with the cutting nozzle assembly 10, accordingly includes an abrasive-conducting inlet 20 communicating via a conduit 24 with an abrasive-conducting outlet 22 formed in the nozzle assembly 10. The conduit 24, conveniently formed from the same material as the line which couples the abrasive source to the cutting nozzle assembly 10, passes through a valving arrangement 26. Preferably, the valving arrangement 26 is a solenoid operated air-driven pinch valve operable by a standard 100 psi source commonly found in industrial environments.

The vacuum nozzle assembly 12 has a jet-discharging tube 122 comparable to the discharge tube 16 of the cutting nozzle assembly 10. The discharge tube 122 is positioned with its jet-discharging end in an energy-dissipating device 25, commonly referred to in the art as a catcher. Since the vacuum nozzle assembly 12 is not intended to cut a workpiece, its components are sized to create maximum suction, rather than an efficient cutting jet. As will be evident, a vacuum from conventional sources of the type found in typical shop environments may be utilized instead of the vacuum nozzle.

Both the cutting nozzle assembly 10 and the vacuum nozzle assembly 12 are controlled by valve means 28, 30 respectively, selectively permit or obstruct the formation of the jets within the nozzle assemblies. Preferably, the valve means 28,30 are air-driven valve structures operable from the same air supply as the abrasive valve 27. One example of suitable valve structures may be found in U.S. Pat. No. 4,313,570 which issued on Feb. 2, 1982 to John H. Olsen. The contents of that patent are incorporated by reference.

Figure 2A:
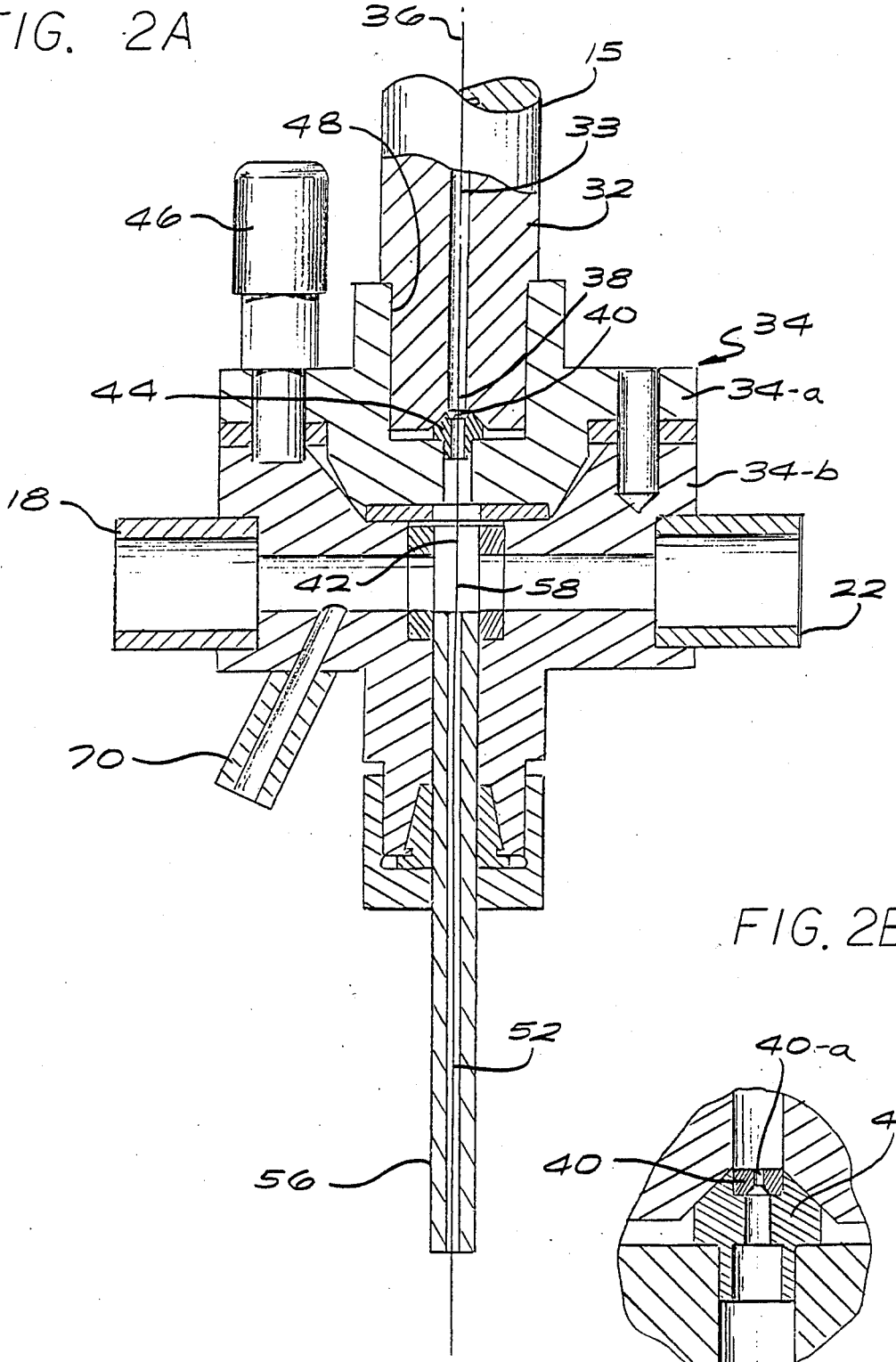
FIG. 2A is a sectional view, in schematic, of an abrasivejet nozzle assembly constructed in accordance with the invention.

FIG. 2A is a sectional view of the cutting nozzle assembly 10, which comprises a waterjet orifice housing 32 and an abrasivejet housing 34. The waterjet orifice housing 32 has an axially-extending passage 33 extending from an upstream end region 36 to a downstream end region 38. Typically, the passage is approximately 0.25 inches in diameter. The inlet port 13 FIG. 1) of the assembly communicates with the upstream end region 36 to permit the ingress of high pressure water into the passage 33.

Figure 2B:
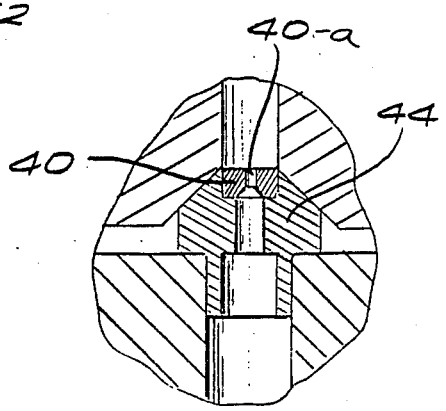
FIG. 2B is a magnified view of the jet-forming orifice member illustrated in FIG. 2A.

A jewel orifice-defining member 40, shown more clearly in magnification in FIG. 2B, has an orifice **40*a* and is positioned in the downstream end region 38 of the passage 33 to produce a highly coherent, high velocity cutting jet 42 from the high pressure water passing through the orifice 40*a*. The jewel orifice member 40 is preferably formed from an extremely hard material such as synthetic sapphire or ruby having a 0.003 to 0.070 inch diameter jet-forming orifice 40*a***. The jewel 40 is mounted on a jewel holder 44 within the passage 33.

The abrasive jet body 34 comprises upper and lower body members 34*a*, 34*b* which are secured together by three screws 46. The upper body member 34*a* is preferably secured to the waterjet housing 15 by internally threaded, cylindrical cavity 48 which threads onto external threads circumventing the downstream end of the waterjet housing 15.

The abutting faces of the upper and lower body members are shaped to form a "ball and socket" arrangement which enables the axially-extending passageway 52 of a discharge tube 56 in the lower member to be axially aligned with the jet-forming orifice 40*a* by means of the selective rotation of the adjustment screws 46. Additional details concerning the alignment mechanism may be found in co-pending U.S. Ser. No. 794,234, filed Oct. 31, 1985 which is assigned to the present assignee. The contents of this patent application are incorporated by reference.

The lower body member further includes an abrasive-conducting entry port 18 for conducting abrasive from an external hopper (or other source) to a mixing region 58 within the lower body member. As known to those skilled in the art, the abrasive are conducted to a mixing region downstream from the jet-producing orifice 40*a* and adjacent the high velocity jet so that the abrasive becomes entrained with the jet by the low pressure region which surrounds the moving liquid in accordance with the Bernoulli Effect.

An outlet port 22 for conducting abrasive-laden liquid is formed in the lower body member 34*b*. The outlet port 22, which communicates with the mixing region, is preferably diametrically opposite to, and co-axially aligned with, the inlet port 18.

The discharge tube 56 is positioned in an axially-extending bore formed within the lower body member 34*b*. The tube 56 is formed from tungsten carbide, or other extremely hard material, and has an internal diameter of from 0.010 to 0.20 inches. The downstream end of the discharge tube 56 discharges the abrasive-laden jet against the workpiece 14 (FIG. 1).

Figure 3:
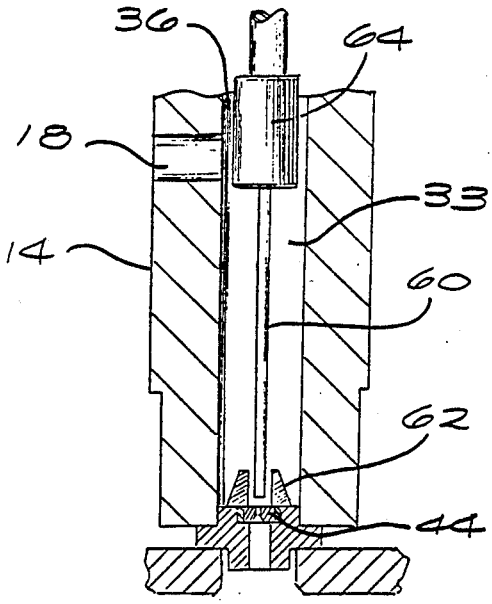
FIG. 3 is an enlarged fragmentary view of the waterjet nozzle portion of FIG. 2A.

To reduce the initial impact of the abrasive-laden jet against a brittle workpiece, the nozzle assembly includes means for degrading the coherency of the waterjet until at least the top surface of the workpiece has been pierced. FIG. 3 is an enlarged fragmentary view of the waterjet nozzle portion of the nozzle assembly in FIG. 2A, and illustrates one embodiment which selectively degrades the waterjet's coherency. In FIG. 3, the waterjet nozzle portion is shown to include a tubular near-jewel insert 62 formed from a non-corroding metal such as stainless steel or brass.

The insert 62 is generally co-axially positioned over the jet-forming orifice 40*a* to receive the downstream end of an elongated stem 60 that extends axially through the passageway 33 of the waterjet body. The outer diameter of the stem is approximately 0.040 inches. The inner diameter of the insert 62 is from 0.002 to 0.030 inches greater than the outer diameter of the stem 60, and has an axial length of from approximately 0.1 to 0.5 inches. The stem 60 serves to block the flow of fluid into the orifice when it is lowered into contact with the face of the orifice-defining jewel element 40.

In operation, the stem 60 is movable axially between a first position in which its downstream end is surrounded by the insert, to a second position in which its downstream end is approximately 0.25 inches above the insert. When extending into the insert, the stem's downstream end cooperates with the inner diameter of the insert to impart a generally annular cross-section to the flow of water into the orifice, degrading the coherency of the jet formed by the orifice. When, on the other hand, the downstream end of the stem is withdrawn to a position approximately 0.25 inches above the top of the insert, the stem is sufficiently displaced from the upstream face of the orifice to avoid degradation of the jet's coherency. The insert may be moved from the downstream end by magnetically responsive material so that its movement can be conveniently induced by magnetic means external to the housing. Naturally, hydraulics and pneumatics may be used instead of magnetics to provide the desired movement.

In another embodiment, the stem may be provided with a radially enlarged portion 64 at its upstream end to degrade the jet's coherency. The outer diameter of the radially enlarged portion 64 of the stem is approximately 0.001 to 0.040 inches less than the inside diameter of the bore 33, and is positioned to partially impede the entry of high pressure fluid through the inlet port 18 when the stem is lifted off the jewel orifice member to permit fluid flow through the orifice. The enlarged segment 64 accordingly creates a degree of turbulence in the incoming high pressure fluid which degrades the coherency of the jet. A stem having the aforedescribed radially enlarged portion can be used with or without an insert 62. When utilized with the insert, the turbulence that it creates supplements the degradation in coherency created by the forced annular flow of the water into the orifice as the water passes around the downstream end of the stem and through the insert 64.

In positioning the enlarged segment on the stem, it is desirable to minimize the required axial movement of the stem, while insuring that a requisite degree of turbulence is generated when needed, and that no coherency-degrading turbulence is generated otherwise. In a typical waterjet nozzle housing, the inlet port 18 is approximately 2 to 4 inches from the upstream face of the jet-forming orifice and has a diameter of approximately 0.187 inches. Accordingly, the radially enlarged stem is moved slightly off the surface of the jewel orifice, the water flow will be turbulent due to the annular entry at port 18. When the stem is moved 0.187 inches away from the jewel orifice member, the enlarged section 64 is in a non-interfering position with respect to the entering water, and the resulting generally laminar flow of water upstream of the jet-defining orifice results in the production of a coherent jet.

Generally, the jet is weakened to a greater degree with high water flow rates and as the position of the enlarged portion is moved downstream. For larger cutting jets of 0.015 to 0.030 inches, the enlarged portion should be 2 to 3 inches above the orifice; for smaller jets of 0.003 inches to 0.010 inches, the enlarged portion should be 0.25 to 1.0 inches from the jewel orifice.

As previously stated, the jet-weakening turbulence is induced during the initial piercing of the workpiece's top surface by the abrasivejet. During that phase of operation, it is important to maintain a constant flow of abrasive from the hopper into the nozzle assembly and to ensure that a sufficient amount of abrasive is entrained into the weakened jet, in spite of the decrease in pulling power exerted by the jet on the abrasive in accordance with Bernoulli's Principle. Additionally, it is highly desirable to prevent abrasive from accumulating in and about the mixing region 58 (FIG. 2A) of the jet nozzle assembly, since the accumulated abrasive can either plug the flow of abrasive entirely or be suddenly entrained into the jet, producing undesirable results.

Accordingly, a provision is made in the illustrated embodiment for maintaining a consistent feed rate of abrasive particles into the assembly during the drilling of a starting hole in the workpiece, and for evacuating non-entrained abrasive from the assembly to prevent accumulation. As previously indicated, the illustrated means for accomplishing these functions are a suction-inducing nozzle assembly 12 (FIG. 1), and an abrasive-conducting discharge port 22 communicating with the mixing region 58 for use in coupling the mixing region to the mixing region of the suction nozzle assembly. Thus, the nonentrained abrasive particles exit from the cutting nozzle assembly 10 via a path which is not directed at the workpiece.

The suction nozzle assembly 12 contains components which are similar to that of the cutting nozzle assembly illustrated in FIG. 2A, except for the absence of an abrasive-conducting discharge port analogous to port 22 and a fluid inlet 70. Additionally, various components of the suction nozzle assembly 12 are sized for maximum suction of the abrasive, rather than for optimal cutting efficiency. The cutting nozzle assembly 10 includes a jet-forming orifice having a diameter in the range of 0.005 to 0.025 inches, and a discharge tube having a diameter in the range of 0.010 to 0.200 inches and a length of approximately 2 to 5 inches. The suction nozzle assembly 12, on the other hand, includes a jet-forming orifice diameter in the range of 0.013 to 0.018 inches diameter, and a discharge tube diameter in the range of 0.062 to 0.100 inches and approximately 2 inches in length to yield sufficient air flow to carry abrasive from the external source through the mixing region of the cutting nozzle assembly 10.

Naturally, any other source of suitable partial vacuum may be utilized in place of the suction nozzle assembly. However, the suction nozzle assembly appears to be a low cost device which accomplishes the function with maximum reliability and minimal maintenance.

To further degrade the jet, external fluid can be entrained into the jet. As illustrated in FIG. 2A, an inlet port 70 in communication with the abrasive-conducting passageway upstream of the mixing region, is furnished to couple a source of low pressure water or other suitable liquid thereto. The low pressure liquid is accordingly permitted to enter the cutting nozzle assembly under the influence of the suction nozzle 12. The inlet port 70 may conveniently be coupled to a conventional water tap, tank or the like. In practice, a low-pressure line allowing up to 10 gpm of water at up to 100 psi of pressure has been found suitable for the connection.

Returning to FIG. 1, the operation of the aforedescribed apparatus is described. The auxiliary suction jet is first activated. Low pressure water is then allowed to flow into the cutting nozzle assembly 10 via inlet port 70 by opening a valve 80 in the low pressure line. The abrasive feed to port 18 is turned on by valving means in the abrasive feed line, and the cutting jet is activated at the same time, or after a short delay. Once the piercing of the workpiece is complete, the flow of the low pressure water through port 70 is halted by closing valve 80. The suction nozzle assembly is disabled, either simultaneously with the closure of valve 80, or shortly thereafter, and the abrasive line between the two nozzle assemblies 10, 12 is closed by a valve. The cutting jet then permitted to cut the workpiece in a manner known in the art.

Figure 4:
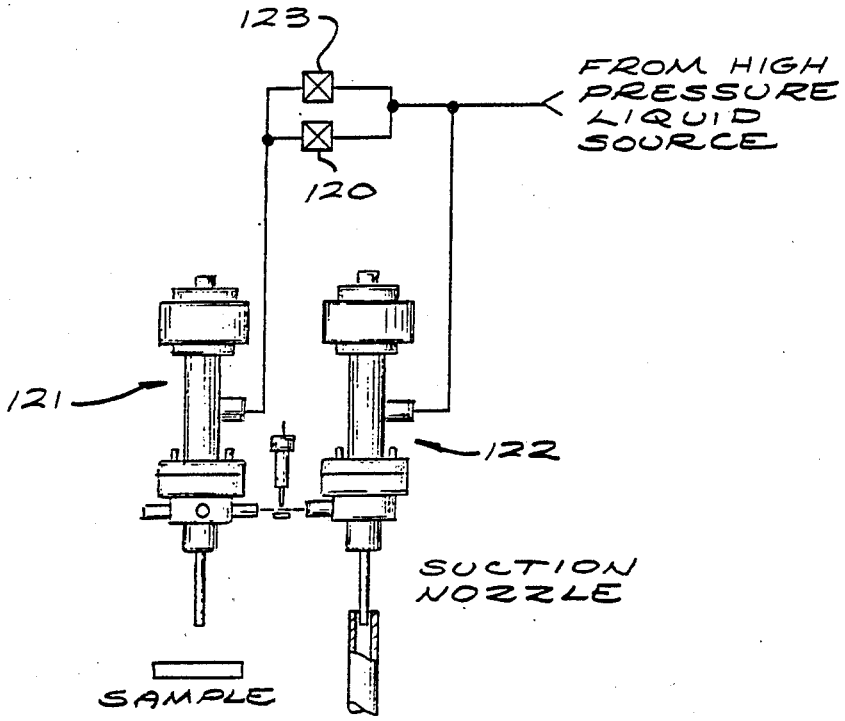
FIG. 4 is a schematic illustration of an alternative abrasivejet cutting system arrangement constructed in accordance with the invention.

The vacuum-assisted abrasive entraining configuration illustrated in FIG. 1 can also be used in conjunction with low pressure operation of the cutting nozzle during the drilling phase. FIG. 4 schematically illustrates such an arrangement. An orifice 120 is mounted in the high pressure input line to the cutting nozzle assembly 121, causing a reduction in pressure upstream of the assembly. This input water at the reduced pressure enters the cutting nozzle assembly during the drilling phase of operation, and the entraining of abrasive is supplemented by the operation of a vacuum nozzle assembly 122 in the manner previously described.

A bypass valve 123, mounted parallel to the orifice 120 in the high pressure line, is opened after drilling is accomplished, resulting in a sudden increase in pressure upstream of the cutting nozzle assembly as the high pressure water bypasses the orifice 120. The valve 26 can be closed, and vacuum nozzle assembly 122 deactivated, after bypass valve 123 is opened, whereupon the cutting operation can commence.

While the foregoing description includes detail which will enable those skilled in the art to practice the invention, it should be recognized that the description is illustrative in nature and that many modifications and variations will be apparent to those skilled in the art having the benefit of these teachings. It is accordingly intended that the invention herein be defined solely by the claims appended hereto and that the claims be interpreted as broadly as permitted in light of the prior art.

We claim:

1. An abrasivejet cutting system for producing an abrasive-laden jet and directing said jet against a workpiece, the cutting system comprising:

(a) nozzle housing means having a fluid-conducting, generally axially-extending passage extending from an upstream end region to a downstream end region, the nozzle housing means including an inlet port communicating with the upstream end region for permitting the ingress of high pressure liquid into the passage;

(b) orifice-defining means positioned in the downstream end region of the passageway to produce a highly coherent, high velocity cutting jet from the high pressure fluid passing through the orifice;

(c) means for conducting abrasive particles from an abrasive source external to the nozzle housing means to a mixing region within the nozzle housing means adjacent the high velocity jet so that the abrasive becomes entrained with the jet by the low pressure region which surrounds a moving fluid;

(d) discharge means for discharging the abrasive-laden jet from the nozzle means at a downstream end; and (e) auxiliary conduit means communicating with the mixing region and providing an alternative discharge path for abrasive material from the nozzle housing means;

(f) means for selectively reducing the impact stress of the abrasive-laden jet on the workpiece while piercing at least the upper surface thereof, the stress reducing means including means for at least partially degrading the coherency of the cutting jet, and (g) means for selectively compelling abrasive from the external source to travel through the mixing region and exit from the nozzle housing means via the auxiliary conduit means.

2. The abrasivejet cutting system of claim 1 wherein the coherency-degrading means includes a liquid-blocking member positioned in the axially-extending passage upstream of the jet-forming orifice, and movable from a coherency-degrading position closely adjacent the jet-forming orifice to an inactive position away from the orifice.

3. The abrasivejet cutting system of claim 2 wherein the liquid-blocking member is formed by the downstream end of a generally axially-extending, axially movable, rod-like stem member positioned in the passage.

4. The abrasivejet cutting system of claim 3 including a collar member circumventing the upstream end of the jet-forming orifice, the stem member being movable generally axially into the collar to define an annular fluid path in conjunction with the collar interior.

5. The abrasivejet cutting system of claim 4 wherein the collar is formed from a material selected from the group consisting of stainless steel and brass.

6. The abrasivejet cutting system of claim 4 wherein the stem member has an external diameter in the range of approximately 0.020 to 0.050 inches, the collar has an internal diameter in the range of approximately 0.022 to 0.080 inches, and the orifice has a diameter of approximately 0.003 to 0.030 inches.

7. The abrasivejet cutting system of claim 3 wherein the stem member includes a flow-restricting surface positionable between the inlet port and jet-forming orifice to induce coherency-degrading turbulence in the high pressure liquid.

8. The abrasivejet cutting system of claim 7 wherein the flow-restricting surface is formed by a radially enlarged portion of the axially extending stem member.

9. The abrasivejet cutting system of claim 8 wherein the outer dimension of the radially enlarged portion of the stem member is in the range of 0.001 to 0.040 inches less than the dimension of the axially-extending passage.

10. The abrasivejet cutting system of claim 3 wherein the stem member is formed from stainless steel.

11. The abrasivejet cutting system of claim 1 wherein stress-reducing means includes means for directing a relatively low pressure liquid at the high pressure jet in the mixing region to degrade the coherency of the jet.

12. The abrasivejet cutting system system of claim 1 wherein the compelling means includes a source of partial vacuum coupled to the auxiliary conduit means for drawing abrasive from the external source via the mixing region.

13. The system of claim 12 wherein the source of partial vacuum includes a flowing fluid having sufficiently high velocity to create a surrounding low pressure region sufficient to draw abrasive from external source via the mixing region in the housing means, and coupling means for permitting the abrasive in the conduit means to communicate with the flowing fluid.

14. The system of claim 13 wherein the source of partial vacuum includes second housing means having a second fluid-conducting, generally axially-extending passage extending from an upstream end region to a downstream end region, the second housing means including an inlet port communicating with the upstream end region for permitting the ingress of high pressure liquid into the passage;

second orifice-defining means positioned in the downstream end region of the second passageway to produce a highly coherent, high velocity liquid jet from the high pressure fluid passing through the second orifice; and discharge means for discharging the jet from the second housing means at a downstream end.

15. For use in an abrasivejet cutting system, a nozzle assembly for producing an abrasive-laden jet and directing said jet against a workpiece, the nozzle assembly comprising:

(a) housing means having a fluid-conducting, generally axially-extending passage extending from an upstream end region to a downstream end region, the housing means including an inlet port communicating with the upstream end region for permitting the ingress of high pressure liquid into the passage;

(b) orifice-defining means positioned in the downstream end region of the passageway to produce a highly coherent, high velocity cutting jet from the high pressure fluid passing through the orifice;

(c) means for conducting abrasive particles from an abrasive source external to the housing means to a mixing region within the housing means adjacent the high velocity jet so that the abrasive becomes entrained with the jet by the low pressure region which surrounds a moving fluid;

(d) discharge means for discharging the abrasive-laden jet from the housing means at a downstream end; and (e) means for selectively and at least partially degrading the coherency of the cutting jet to substantially reduce the impact stress of the abrasive-laden jet on the workpiece.

16. The nozzle assembly of claim 15 wherein the coherency-degrading means includes a liquid-blocking member positioned in the axially-extending passage upstream of the jet-forming orifice, and movable from a coherency-degrading position closely adjacent the jet-forming orifice to an inactive position away from the orifice.

17. The nozzle assembly of claim 16 wherein the stem member is formed from stainless steel.

18. The nozzle assembly of claim 16 wherein the liquid-blocking member includes the downstream end of a generally axially-extending, axially movable, rod-like stem member positioned in the passage.

19. The nozzle assembly of claim 18 wherein the stem member includes at least a region of magnetically responsive material.

20. The nozzle assembly of claim 19 wherein the collar is formed a material selected from the group consisting of steel and brass.

21. The nozzle assembly of claim 19 wherein the stem member has an external diameter in the range of approximately 0.020 to 0.050 inches, the collar has an internal diameter in the range of approximately 0.022 to 0.080 inches, and the orifice has a diameter of approximately 0.005 to 0.030 inches.

22. The nozzle assembly of claim 21 wherein the flow-restricting surface is formed by a radially enlarged portion of the axially extending stem member.

23. The nozzle assembly of claim 22 wherein the outer dimension of the radially enlarged portion of the stem member is in the range of 0.001 to 0.040 inches less than the dimension of the axially-extending passage.

24. The nozzle assembly of claim 18 including a collar member circumventing the upstream end of the jet-forming orifice, the stem member being movable generally axially into the collar to define an annular fluid path in conjunction with the collar interior.

25. The nozzle assembly of claim 24 wherein the stem member includes a flow-restricting surface positionable between the inlet port and jet-forming orifice to induce coherency-degrading turbulence in the high pressure liquid.

26. The nozzle assembly of claim 15 including egress means for permitting the egress of abrasive from the mixing region without exiting from the downstream end of the discharge means.

27. The nozzle assembly of claim 15 including ingress means for permitting the entry of low pressure liquid into the mixing region without passing through the jet-forming orifice.

28. An abrasivejet cutting system comprising:

(A) a first nozzle assembly including (i) housing means having a fluid-conducting, generally axially-extending passage extending from an upstream end region to a downstream end region, the housing means including an inlet port communicating with the upstream end region for permitting the ingress of high pressure liquid into the passage;

(ii) orifice-defining means positioned in the downstream end region of the passageway to produce a highly coherent, high velocity cutting jet from the high pressure fluid passing through the orifice;

(iii) means for conducting abrasive particles from an abrasive source external to the housing means to a mixing region within the housing means adjacent the high velocity jet so that the abrasive becomes entrained with the jet by the low pressure region which surrounds a moving fluid;

(iv) discharge means for discharging the abrasive-laden jet from the housing means at a downstream end; and (v) conduit means other than the abrasive-conducting means and the discharge means communicating with the mixing region and the exterior of the housing means;

(B) an input line for conducting a high pressure liquid from a high pressure source to the inlet port of the nozzle assembly;

(C) means for selectively and at least partially reducing the impact stress of the abrasive-laden jet on at least an initial site on the workpiece until at least the upper surface thereof has been pierced; and (D) means for selectively compelling abrasive from the external source to travel through the mixing region and exit from the housing means via the conduit means.

29. The system of claim 28 wherein the stress-reducing means includes means having a pressure reducing orifice positioned in the input line to reduce the pressure of the fluid entering the input port of the nozzle assembly, and bypass valve means for permitting the high pressure fluid to selectively bypass the pressure-reducing orifice to impose full impact stress on the workpiece.

* * * * *